US007614172B2

(12) United States Patent
Kennedy et al.

(10) Patent No.: US 7,614,172 B2
(45) Date of Patent: Nov. 10, 2009

(54) HOISTING, RETENTION AND REMOVAL APPARATUS FOR BANNERS, SIGNS AND LIKE

(76) Inventors: Louis Leon Kennedy, 35584 Ruth Ave., Wildomar, CA (US) 92595; Stephen Donald Parker, 2720 E. Walnut #67, Orange, CA (US) 92867

( * ) Notice: Subject to any disclaimer, the term of this patent is extended or adjusted under 35 U.S.C. 154(b) by 166 days.

(21) Appl. No.: 11/062,915

(22) Filed: Feb. 22, 2005

(65) Prior Publication Data

US 2005/0183304 A1 Aug. 25, 2005

Related U.S. Application Data

(60) Provisional application No. 60/547,048, filed on Feb. 24, 2004.

(51) Int. Cl.
*G09F 17/00* (2006.01)

(52) U.S. Cl. ..... 40/604; 40/601; 40/603; 40/613

(58) Field of Classification Search ..... 40/601, 40/603, 604, 606.03, 606.11; 294/82.11; 194/82.12; 242/388.2
See application file for complete search history.

(56) References Cited

U.S. PATENT DOCUMENTS 5,471,774 A * 12/1995 Hoyt et al. ..... 40/601
6,718,668 B2 * 4/2004 Cozzilino ..... 40/604
7,117,620 B2 * 10/2006 Tolna ..... 40/601

* cited by examiner

*Primary Examiner*—Lesley D Morris
*Assistant Examiner*—Shin Kim
(74) *Attorney, Agent, or Firm*—Hoffman, Wasson & Gitler

(57) ABSTRACT

A hoisting, retention and removal apparatus for banners or signs, having two upper embodiments to be securely fastened to any vertical surface. They are designed to be mounted level with and opposite each other placed at a distance apart based on the need at a distance larger than the maximum length of sign or banner for which it will accommodate. Two lower embodiments are mounted directly below each upper embodiment within reach of the operator when standing on the ground or platform below the banner or sign display area. Four fiber ropes, each terminating with a safety snap device, are connected each to one corner of a sign or banner, routed through sheaves in the upper frame and are held taut by means of locking cleat in each of the lower enclosures. Position and tautness are achieved by adjustment of the fiber ropes in the lower enclosures.

9 Claims, 5 Drawing Sheets

HOISTING, RETENTION AND REMOVAL APPARATUS FOR BANNERS, SIGNS AND LIKE

RELATED APPLICATIONS

The present application is a continuation-in-part application of U.S. provisional patent application, Ser. No. 60/547,048, filed Feb. 24, 2004, included by reference herein and for which benefit of the priority date is hereby claimed.

FIELD OF THE INVENTION

This invention relates generally to the field of apparatus for hoisting, retention and removal device for banners, signs, or like. Moreover it pertains specifically to such apparatus for hoisting articles, including banners, signs or like, retention of same for various time periods as required, and subsequent removal when desired, by means of attaching the apparatus to a building or other structure upon which to display the articles.

BACKGROUND OF THE INVENTION

In view of the limitations now present in the prior art, the present invention provides a new and useful Hoisting, Retention and Removal Apparatus for Banners, Signs and Like, which is simpler in construction, more universally usable and more versatile in operation than known apparatus of this kind.

The purpose of the present invention is to provide a new Hoisting, Retention and Removal Apparatus for Banners, Signs and Like device that has many novel features not offered by the prior art apparatus that result in a Hoisting, Retention and Removal Apparatus for Banners, Signs and Like device which is not apparent, obvious, or suggested, either directly or indirectly by any of the prior art apparatus The present invention generally comprises four components which consist of two upper extruded embodiments shaped to enclose four sheaves through which four fiber ropes are extended from two lower embodiments. Two upper embodiments and two lower embodiments are placed in opposition to each other at desired distance to provide positioning for suspension and anchoring of fabric banners or signs or like. By means of safety snap hooks placed on upper ends of each of four fiber ropes and connected through grommets placed in banner or sign corners, then routed over sheaves and out the bottom of the upper embodiment, extending down into the top of lower embodiment, the banner or sign is drawn into display position by means of manually pulling the fiber ropes extended down from each of the upper embodiments. During the hoisting operation, the fiber ropes are drawn around sheaves in the lower embodiments and temporarily retained in toothed cam locks while the operator moves between the two lower embodiments making adjustments to both tension and positioning of the banner or sign. When the adjustment of position is acceptable to the operator, the excess fiber ropes in each of the lower embodiments is wound around cleats placed for that purpose in each of the lower embodiments. A hinged cover is then closed concealing the fiber ropes, sheaves and toothed cam locks, which can be secured with a common padlock placed through holes located in front and back of the lower embodiment.

The foregoing has outlined, in general, the physical aspects of the invention and is to serve as an aid to better understanding the more complete detailed description which is to follow. In reference to such, there is to be a clear understanding that the present invention is not limited to the method or detail of construction, fabrication, material, or application of use described and illustrated herein. Any other variation of fabrication, use, or application should be considered apparent as an alternative embodiment of the present invention.

A principal object of the present invention is to provide Hoisting, Retention and Removal Apparatus for Banners, Signs and Like that will overcome the deficiencies of the prior art devices.

An object of the present invention is to provide Hoisting, Retention and Removal Apparatus for Banners, Signs and Like device allows for hoisting of banners or signs without the need for ladders or scaffolding to install banners or signs at heights previously reached with ladders or scaffolding.

Another object of the present invention is to provide Hoisting, Retention and Removal Apparatus for Banners, Signs and Like device allows for adjustment, tensioning and positioning of banners or signs or the like, from a position on the ground or other position below the heights required for display of banners or signs or the like.

Another object of the present invention is to provide Hoisting, Retention and Removal Apparatus for Banners, Signs and Like device that results in cost savings when displaying banners or signs by providing for fast hoisting and lowering of banners or signs without need for other equipment, ladders or scaffolding.

Another object of the present invention is to provide a Hoisting, Retention and Removal Apparatus for Banners, Signs and Like that results in a safer working environment for anyone who installs banners, signs and the like with the present invention, due to the elimination of requirement for use of ladders or scaffolding.

It is intended that any other advantages and objects of the present invention that become apparent or obvious from the detailed description or illustrations contained herein are within the scope of the present invention.

SUMMARY OF THE INVENTION

In accordance with the present invention, there is provided a hoisting, retention and removal apparatus for banners, signs and like, having two upper embodiments, each consisting of an extruded frame housing four sheaves, designed to be securely fastened to any vertical surface by utilization of fastener holes provided on the vertical face of the upper frame. The two upper frames are designed to be mounted level with and opposite each other with the open sides facing each other. The two upper frames are placed at a distance apart based on the needs of the user and is generally a distance larger than the maximum length of sign or banner for which it will accommodate. Two lower components, each consisting of an enclosed device, with openings top and bottom, with a lockable hinged cover, are mounted directly below each upper frame within reach of the operator when standing on the ground or platform below the banner or sign display area. The two lower components enclose a locking cleat, guides and rope cleats for securing fiber ropes. Four fiber ropes, each terminating with a safety snap device, are connected each to one corner of a sign or banner, routed through sheaves in the upper frame, down through locking cleat in the lower enclosure and are held taut by means of said locking cleat in each of the lower enclosures. Adjustment of the banner position and tautness is achieved by alternating adjustment of the fiber ropes in either of the lower enclosures. To secure the banner or sign in position, the fiber ropes are drawn around two cleats and tied off in each of the lower enclosures. A hinged door on each of the lower enclosures is closed and locked by means of a padlock or other suitable locking device.

BRIEF DESCRIPTION OF THE DRAWINGS

A complete understanding of the present invention may be obtained by reference to the accompanying drawings, when considered in conjunction with the subsequent, detailed description, in which:

FIG. 1 is a perspective view of a hoisting, retention and removal apparatus for banners, signs and like;

For purposes of clarity and brevity, like elements and components will bear the same designations and numbering throughout the FIGURES.

DESCRIPTION OF THE PREFERRED EMBODIMENT

Referring now descriptively to the drawings, the attached figures illustrate a Hoisting, Retention and Removal Apparatus for Banners, Signs and Like.

Figure 1:
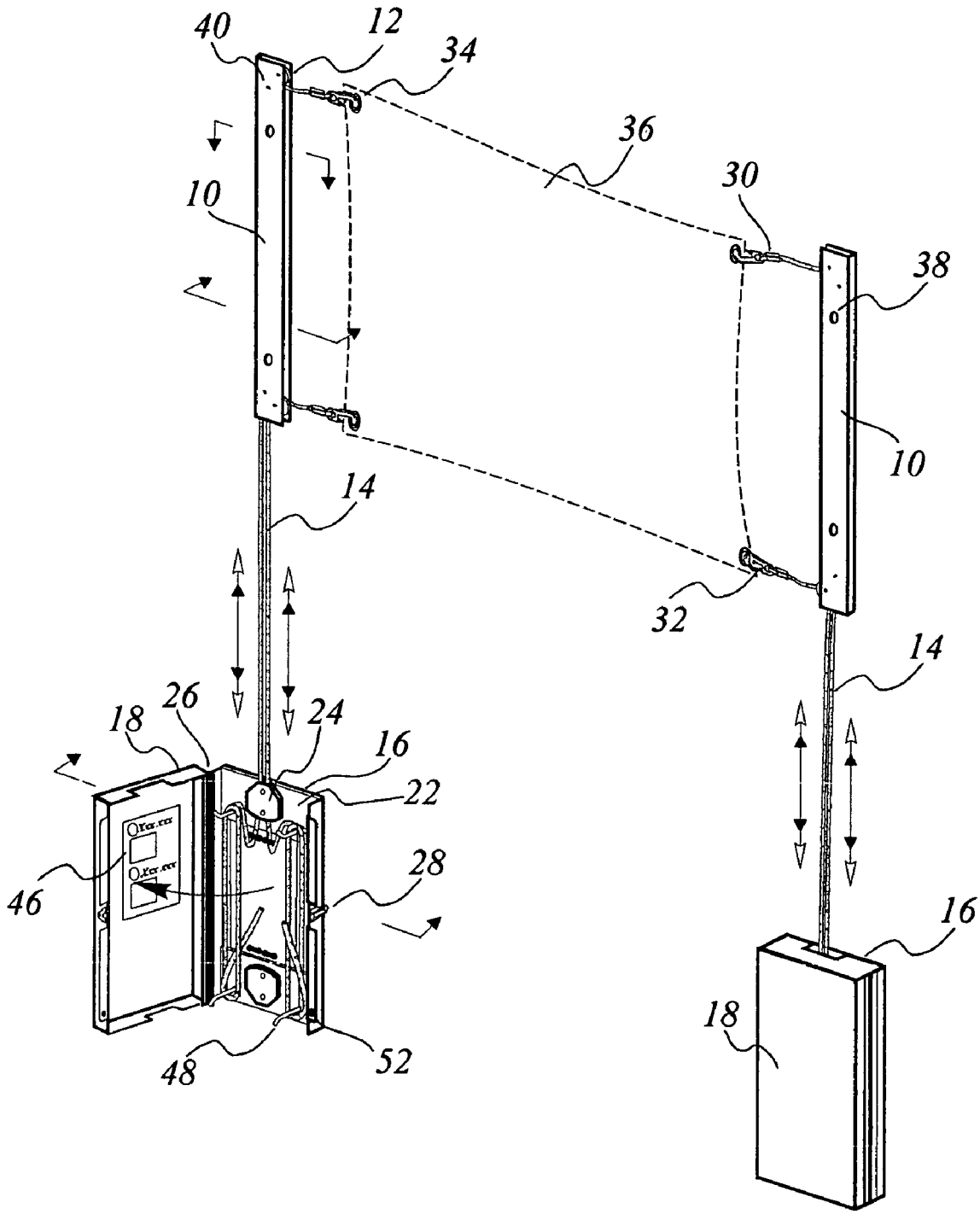

FIGS. 1 illustrates a Hoisting, Retention and Removal Apparatus for Banners, Signs and Like according to the present invention facilitating the hoisting of banners, signs and the like into display position, adjustment of the display position, retention of the banner or sign or the like during display, and subsequent removal of the banner, sign or the like when desired.

Figure 2:
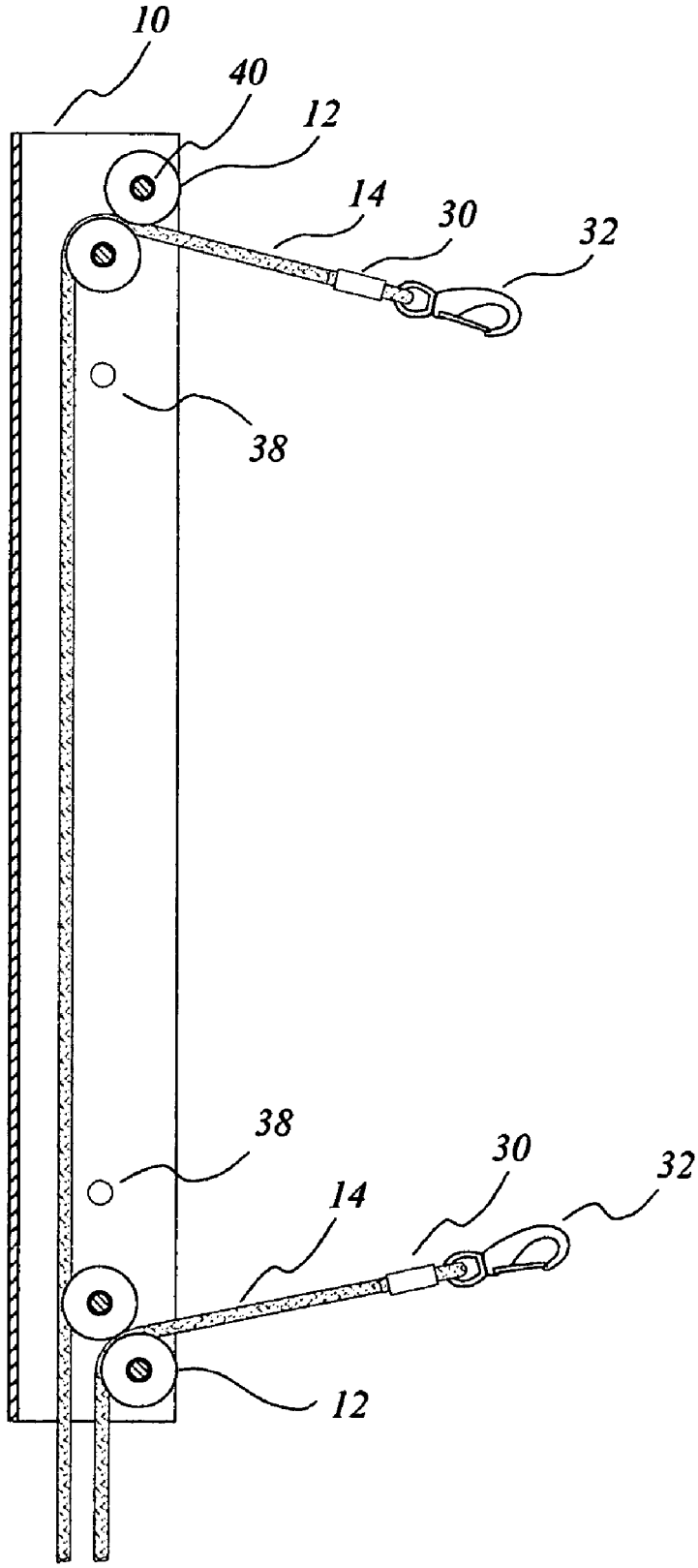
FIG. 2 is a cross sectional view of an upper embodiment of the present invention seen in FIG. 1.

FIG. 2 is a cross sectional view of the upper support embodiment 10 of the present invention seen in FIG. 1.

Figure 3:
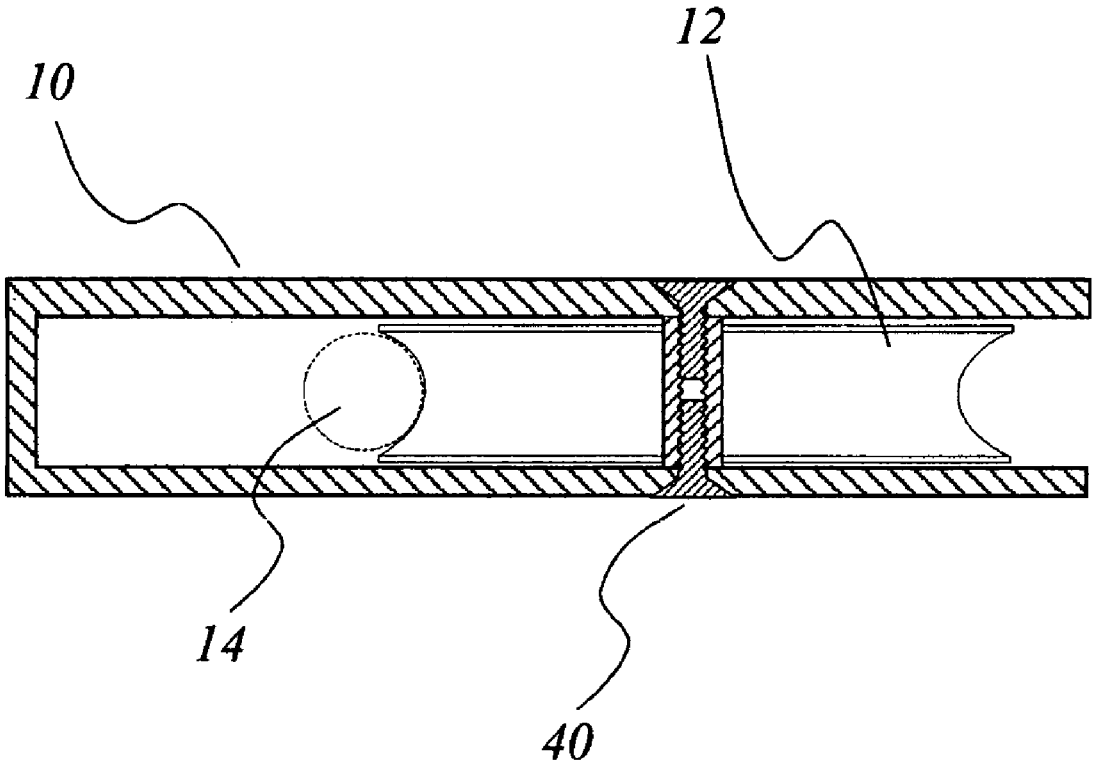
FIG. 3 is a cross sectional view of an upper of the embodiment of the present invention seen in FIG. 2.

FIG. 3 is a cross sectional view of the upper support embodiment 10 of the present invention seen in FIG. 2.

Figure 4:
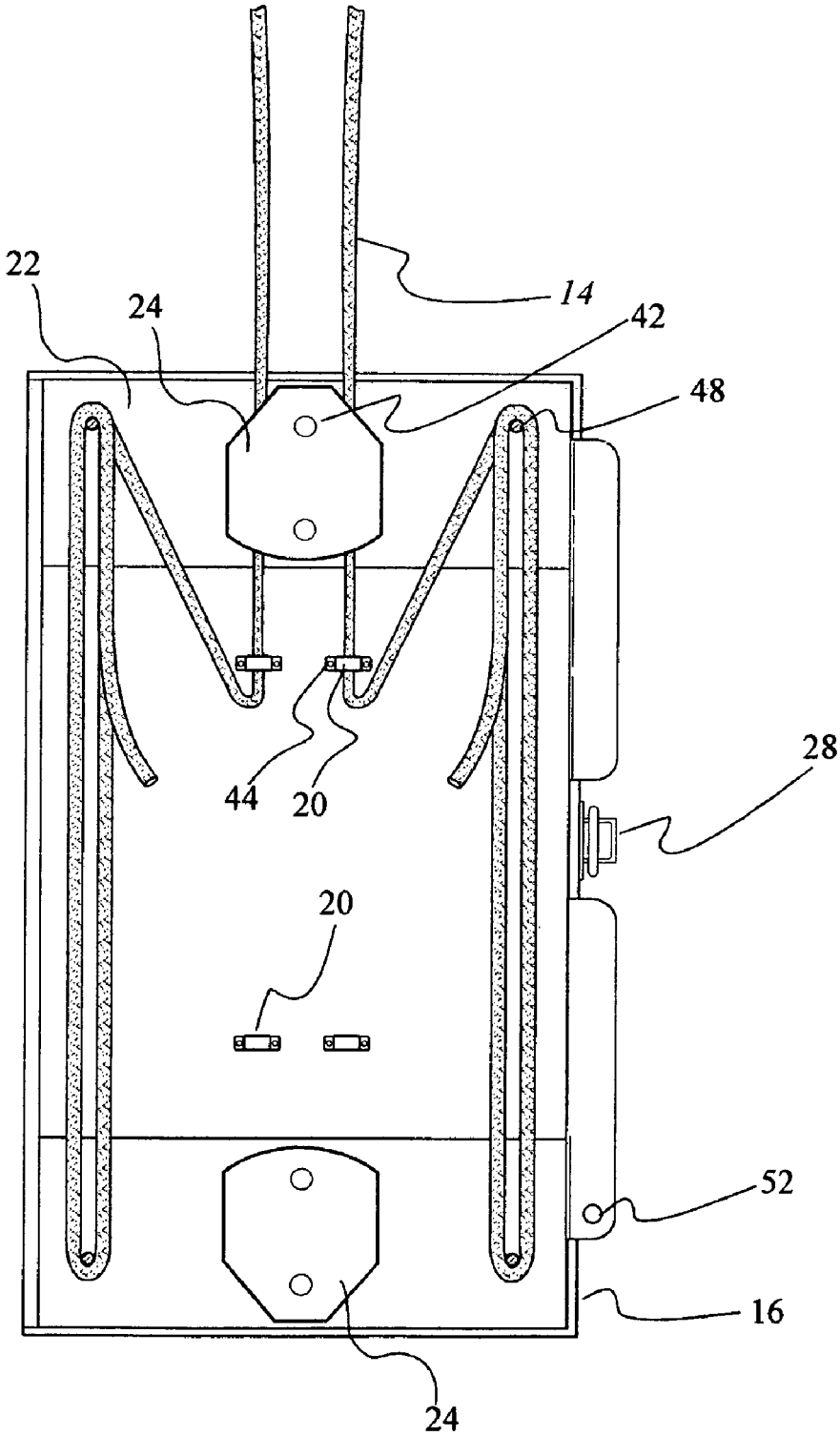
FIG. 4 is a cross sectional view of a lower control box embodiment of the present invention seen in FIG. 1.

FIG. 4 is a cross sectional view of a lower control box embodiment 16 of the present invention seen in FIG. 1.

Figure 5:
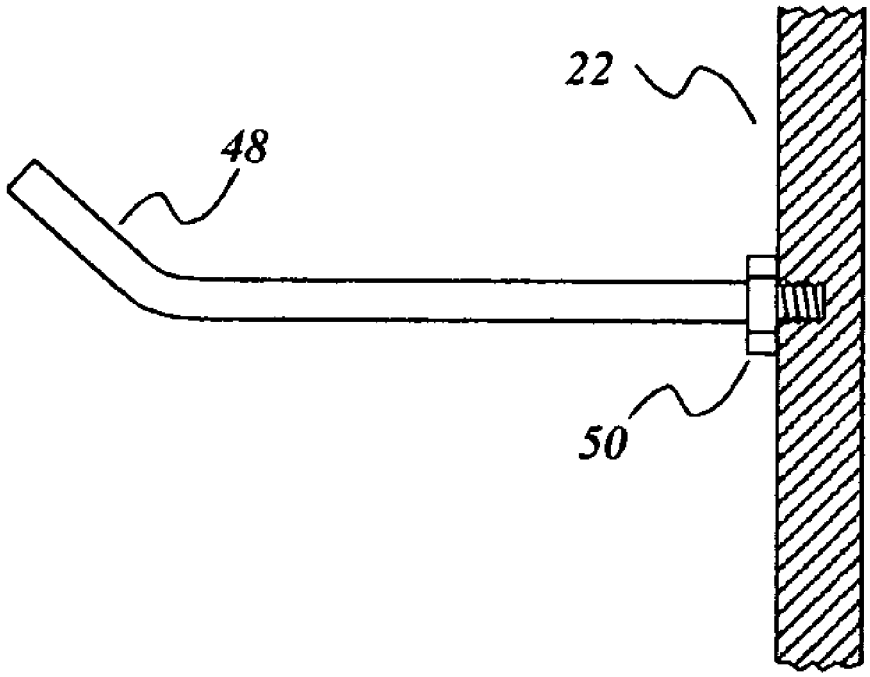
FIG. 5 is a side view of an element 48 of the present invention as seen in FIG. 4.

FIG. 5 is a side view of rope storage cleat 48 of the present invention as seen in FIG. 4.

The present invention generally comprises of components which consist of two of the upper support embodiment 10 as seen in FIG. 1, each shaped to enclose four Sheaves 12, each fastened to the upper support embodiment 10 with sheave screw 40. Through the Sheaves 12, a fiber rope 14, is extended to the lower control box embodiment 16. Two upper support embodiment 10 and two lower control box embodiment 16 are placed in opposition to each other at desired distance to provide positioning for suspension and anchoring of banner, sign or like 36. mounting hole 38 in the upper support embodiment 10, and in the lower control box embodiment 16, are provided as means to fasten the embodiments to wall or other support structure as required by user. By means of safety snap hook 32, such as Model 249B sold by VerSales Corporation, of Burbank, Calif., placed on upper end of each of fiber rope 14, such placement achieved by use of crimp type fiber rope clamp 30, and connected through grommet 34 placed in banner, sign or like 36, then routed over sheaves 12 , and out the bottom of the upper support embodiment 10, extending down into the top of lower control box embodiment 16, the banner, sign or like 36 is drawn into display position by means of manually pulling the fiber rope 14, extended down from each of the upper support embodiment 10. During the hoisting operation, the fiber rope 14, are drawn through locking type rope cleat 24, such as Model CL202 ClamCleat as manufactured by Seadog Corporation, of Everett, Wash., which is attached to the lower control box embodiment 16 with cleat screw 42. The fiber rope 14 is routed through an eyelet 20, such as Model 23590, manufactured by Binnacle Corp, which is anchored with blind rivet 44 to the plate 22 in the lower control box embodiment 16 and retained in place while the operator moves between the two lower control box embodiment 16 making adjustments to both tension and positioning of the banner, sign or like 36 When the adjustment of position is acceptable to the operator, the excess fiber rope 14 in each of the lower control box embodiment 16 is wound around rope storage cleat 48 placed for that purpose and held in place with nut 50 tightened up to mounting plate 22 in each of the lower control box embodiment 16 A hinged cover 18 is attached to lower control box embodiment 16 by use of a hinge 26 then closed and secured with latch 28 concealing the fiber rope 14, which can then be secured with a common padlock placed through padlock hole 52 located in front and back of the lower control box embodiment 16. A self adhesive illustrated instruction label 46 is placed inside hinged cover 18.

It will also be understood that, in addition to hoisting, retention and removal of banners, signs and like, the device can be used hoist, retain and provide for removal of large flags, advertising balloons and other items requiring installation on buildings at heights normally achieved only by ladder or manlift apparatus.

It is further intended that any other embodiments of the present invention that result from any changes in application or method of use or operation, method of manufacture, shape, size, or material which are not specified within the detailed written description or illustrations contained herein yet are considered apparent or obvious to one skilled in the art are within the scope of the present invention.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A hoist for hoisting and retaining a banner or sign, comprising:

first and second upper supports between which the banner or sign is supported, said first and second upper supports attached to a wall or similar structure;

first and second lower control boxes, said first lower control box aligned with said first upper support and said second control box aligned with said second lower support;

first attachment means moveably extending from said first lower control box, through said first upper support and exiting from said first upper support, for securing the banner or sign;

second attachment means moveably extending from said second lower control box, through said second upper support and exiting from said second upper support for securing the banner or sign;

first pair of guide means provided in said first upper support for guiding said first attachment means as it exits from said first upper support;

second pair of guide means provided in said second upper support for guiding said second attachment means as it exits from said second upper support;

first cleat provided in said first lower control box through which said first attachment means would pass;

second cleat provided in said second lower control box through which said second attachment means would pass;

first securing means provided in and directly attached to said first lower control box beyond said first cleat for securing an excess portion of said first attachment means after the position of the banner or sign has been finalized; and second securing means provided in and directly attached to said second lower control box beyond said first cleat for securing an excess portion of said second attachment mans after the position of the banner or sign has been finalized.

2. The hoist in accordance with claim 1, further including a third attachment means moveably extending from said first lower control box, through said first upper support and exiting from said first upper support, said third attachment means extending through said first cleat, as well as further including a fourth attachment means moveably extending from said second lower control box, through said second upper support and exiting from said second upper support, said fourth attachment means extending through said second cleat.

3. The hoist in accordance with claim 2, wherein said first, second, third and fourth attachment means is a rope.

4. The hoist in accordance with claim 2, further including a third pair of guide means provided in said first upper support for guiding said third attachment means as it exits from said first upper support, as well as further including a fourth pair of guide means provided in said second upper support for guiding said fourth attachment means as it exits from said second upper support.

5. The hoist in accordance with claim 4, wherein said first, second, third and fourth guide means are sheaves, said first and third guide means, secured to an interior surface of said first upper support and said second and fourth guide means secured to an interior surface of said second upper support.

6. The hoist in accordance with claim 2, further including a third securing means provided in, and directly attached to said first lower control box beyond said first cleat, for securing an excess portion of said third attachment means after the position of the banner or sign has been finalized as well as further including a fourth securing means provided in, and directly attached to said second lower control box beyond said second cleat, for securing an excess portion of said fourth attachment means after the position of the banner or sign has been finalized.

7. The hoist in accordance with claim 6, wherein said first securing means comprises a first eyelet through which said first attachment means extends and a first storage cleat around which said first attachment means is wound, said second securing means comprises a second eyelet through which said second attachment means extends and a second storage cleat around which said second attachment means is wound, said third securing means comprises a third eyelet through which said third attachment means extends and a third storage cleat around which said third attachment means is wound and said fourth securing means comprises a fourth eyelet through which said fourth attachment means extends and a fourth storage cleat around which said fourth attachment means is wound.

8. The hoist in accordance with claim 2, further including first, second, third and fourth snap hooks attached to the ends of said first attachment means, said second attachment means, said third attachment means and said fourth attachment means respectively, said first, second, third and fourth snap hooks removably attached to the banner or sign.

9. The hoist in accordance with claim 1, wherein each of said first and second lower control boxes is provided with a moveable door provided with a hinge.

* * * * *